US005159966A

United States Patent [19]

Fleishman et al.

[11] Patent Number: 5,159,966

[45] Date of Patent: Nov. 3, 1992

[54] FAN-TYPE BLIND FOR SEMICIRCULAR ARCHED WINDOW

[76] Inventors: Ron Fleishman; Lorraine Fleishman, both of 1225 Tamiami Trail, Port Charlotte, Fla. 33953

[21] Appl. No.: 575,827

[22] Filed: Aug. 30, 1990

[51] Int. Cl.[5] ..... E06B 9/06

[52] U.S. Cl. ..... 160/84.1; 160/330; 160/134

[58] Field of Search ..... 160/84.1, 38, 39, 19, 160/134, 32, 330

[56] References Cited

U.S. PATENT DOCUMENTS

| | | | |
|---|---|---|---|
| 190,348 | 5/1877 | May | 160/134 |
| 1,609,877 | 12/1926 | Kendall | 160/134 X |
| 1,613,364 | 1/1927 | Thompson | 160/134 X |
| 1,781,777 | 11/1930 | Conner | 160/134 |
| 1,927,137 | 9/1933 | Soukup | 160/134 X |
| 3,386,106 | 6/1968 | Clemens | 160/84.1 X |
| 3,649,069 | 3/1972 | Zip | 160/134 X |
| 4,222,156 | 9/1980 | Anderle | 160/38 X |
| 4,699,195 | 10/1987 | Lester | 160/134 |
| 4,934,434 | 6/1990 | Schnebly et al. | 160/134 X |
| 5,044,418 | 9/1991 | Donahue | 160/84.1 X |

FOREIGN PATENT DOCUMENTS

| | | | |
|---|---|---|---|
| 565330 | 3/1958 | Belgium | 160/134 |

*Primary Examiner*—Blair M. Johnson

*Attorney, Agent, or Firm*—Fleit, Jacobson, Cohn, Price, Holman & Stern

[57] ABSTRACT

A blind for an arched window and more specifically a fan-type blind for semicircular arched windows in the form of a semicircular radially pleated member supported along its bottom edge by a mounting rail which is supported by end mounting brackets attached to a window casing. Compression plates engage the opposed surfaces of the radial pleats to partially compress the rigidify the pleats and enable adjustment of the pleats to accommodate irregularities in the window casing with the blind standing on its own without top brackets. A valance of pleated construction overlies the mounting rail and a medallion of semicircular configuration of radially pleated construction overlies a central portion of the fan-type blind.

7 Claims, 1 Drawing Sheet 3
18
10
20
16
26
4
24
22
4
52
34
36
3
54
38
44
42
14

18
20
34
32
38
40
50
52

26
16
24
22
44
42

16
18
20
32
12
34
40
38
30
28
56
48
42
46
44
22
36

FAN-TYPE BLIND FOR SEMICIRCULAR ARCHED WINDOW

BACKGROUND OF THE INVENTION

1. Field of the Invention

The present invention generally relates to a blind for an arched window and more specifically a fan-type blind for semicircular arched windows in the form of a semicircular radially pleated member supported along its bottom edge by a mounting rail which is supported by end mounting brackets attached to a window casing. Compression plates engage the opposed surfaces of the radial pleats to frictional clamp and partially compress the pleats to reinforce the blind and enable adjustment thereof with the blind standing on its own without top brackets. A horizontal valance of pleated construction overlies the mounting rail and a medallion of semicircular configuration of radially pleated construction overlies a central lower portion of the fan-type blind to provide a blind which is adjustable with the compression feature allowing the fan-type blind to be adjusted permanently in place to accommodate slightly irregular window casings. The blind does not collapse and is not foldable nor can it be opened but provides a stable and attractive blind for arched windows.

2. Description of the Prior Art

Windows and, in some instances, doorways are frequently provided with a semicircular arched window at the top of the usually provided rectangular window or doorway. Fan-type blinds have been provided for arched windows. The following U.S. patents illustrate the prior art in this field of endeavor:

U.S. Pat. No. 451,068
U.S. Pat. No. 602,967
U.S. Pat. No. 1,609,877
U.S. Pat. No. 4,699,195
U.S. Pat. No. 4,776,380

While fan-type blinds for arched windows are generally known, most of them utilize radial slats which can be pivoted about a center point at the base of the arched window in order to open and close the blind. The prior art does not disclose the specific structure of the blind of the present invention which is not openable but is adjustable and retained in self-sustaining relation by compression plates associated with the radial pleats forming the blind.

SUMMARY OF THE INVENTION

An object of the present invention is to provide a fan-type blind for semicircular arched window with the blind being constructed from semi-rigid material such as plastic or fabric-type material formed by a plurality of radial accordion fold pleats having a horizontal bottom edge and a semicircular free edge supported in the arched window casing by a horizontally disposed mounting rail forming the bottom of the blind with compression plates engaging opposed crests of the radial pleats about the point of radiation to secure the pleats in adjusted position and maintain them in self-sustaining relationship to support the blind in the window casing without the use of top anchoring brackets.

Another object of the invention is to provide a blind in accordance with the preceding object in which a pleated valance is positioned against the outer surface of the mounting rail to conceal the mounting rail and enhance the appearance characteristics of the blind.

A further object of the invention is to provide a blind in accordance with the preceding objects in which a semicircular medallion having radial pleats overlies the portion of the pleated blind engaged by the compression plates with the compression plates being interconnected by a nut and bolt assembly to enable adjustment of the pleated blind and compressing the pleats of the blind sufficient to retain the pleats of the fan-type blind in adjusted position which enables the blind to compensate for and accommodate irregularities in the window and window casing.

These together with other objects and advantages which will become subsequently apparent reside in the details of construction and operation as more fully hereinafter described and claimed, reference being had to the accompanying drawings forming a part hereof, wherein like numerals refer to like parts throughout.

DESCRIPTION OF THE PREFERRED EMBODIMENT

Figure 1:
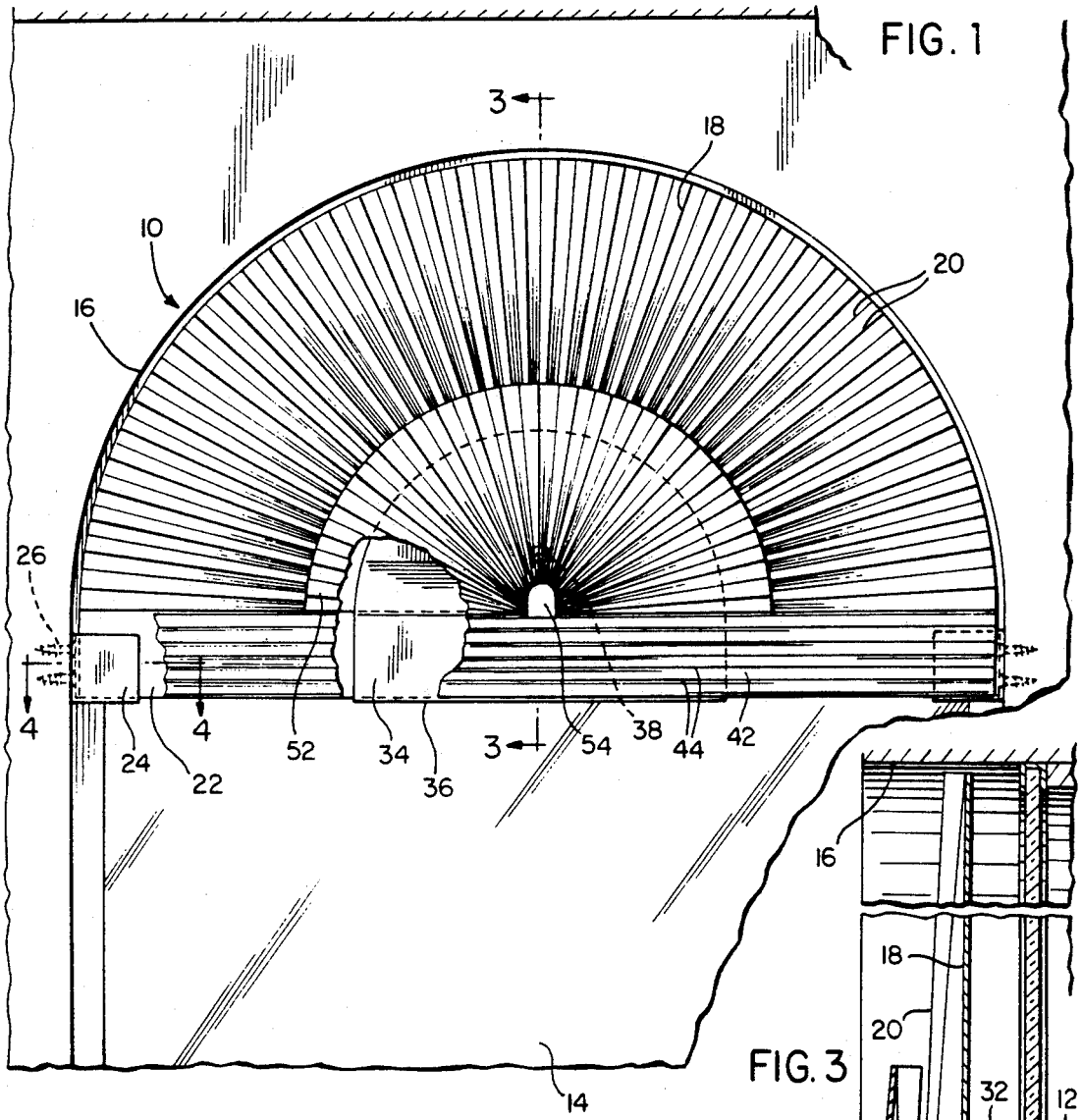
FIG. 1 is an elevational view of the fan-type blind for semicircular arched windows of the present invention.

Referring now specifically to the drawings, the fan-type blind for semicircular arched windows is generally designated by reference numeral 10 and is positioned in spaced parallel relation to an arched window 12 positioned above a conventional window 14 or above a doorway or the like with the arched window being received in a casing 16 and being of conventional construction.

The blind 10 of the present invention includes a semicircular fan-like panel 18 formed by a plurality of radially extending, accordion folding pleats 20 in which the crests forming the opposite extremities of the pleats radiate outwardly in diverging relation from the center bottom edge of the panel 18. The panel 18 is constructed of semi-rigid material such as plastic or fabric-type material having any decorative appearance characteristics desired depending upon the installational requirements.

Figure 3:
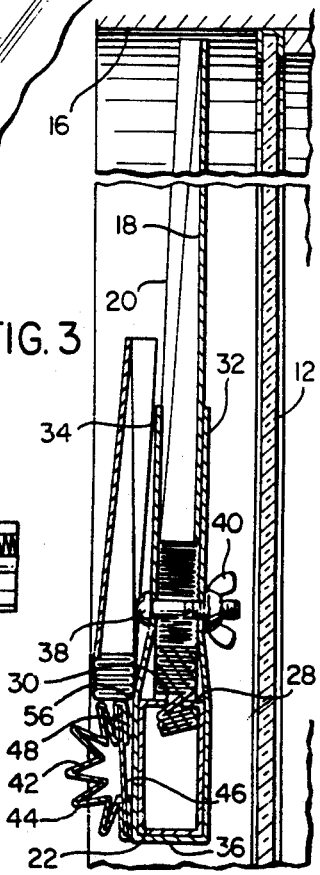
FIG. 3 is a vertical sectional view taken substantially upon a plane passing along section line 3—3 on FIG. 1 illustrating the specific structural details of the blind.

Extending along the bottom of the fan-like panel 18 is a mounting rail 22 which is horizontally oriented and as illustrated in FIGS. 3 an 4 is in the form of a hollow box-shaped member of rectangular configuration. The opposite ends of the supporting rail 22 are supported by a bracket structure 24 which has a bottom, front and rear panels and an outer end panel secured to the window casing 14 by suitable fasteners 26 to support the mounting rail securely but detachably in horizontal position. The mounting rail 22 includes an upper wall 28 having a longitudinal slot 30 therein by which one or more of the pleats 20 are inserted for positioning interiorally of the mounting rail thereby enabling the pleats 20 above the mounting rail 22 to be uniformally displaced so that all of the pleats are equally spaced in the semicircular array. This also provides a positive interconnection between the panel 18 and the mounting rail for rigidifying the bottom edge of the panel 18.

Figure 2:
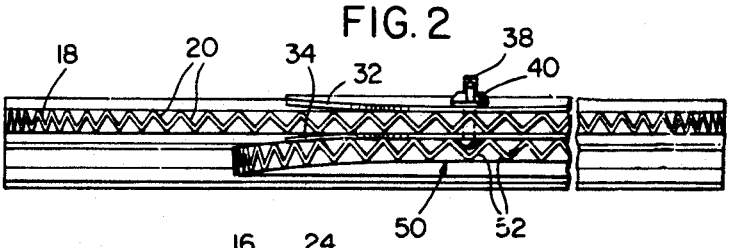
FIG. 2 is a top plan view thereof with portions broken away.
Figure 4:
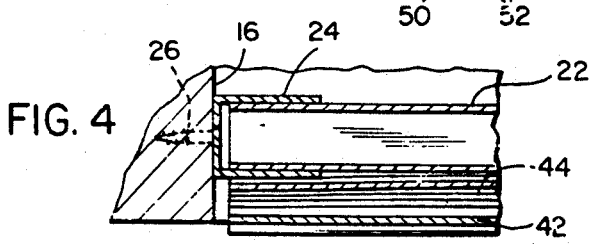
FIG. 4 is a fragmental sectional view taken along section line 4—4 on FIG. 1 illustrating the mounting bracket structure for the mounting rail.

The fan-like panel 18 is rigidified and held in place by a pair of clamping or compression plates 32 and 34 which engage the front and rear surfaces of the panel 18 and which extend downwardly and continuously under the mounting rail as indicated by reference numeral 36. A clamp bolt 38 with a wing nut 40 thereon extends through the clamping plates 32 and 34 and through the panel 18 at a point immediately above the bottom center thereof as illustrated in FIGS. 1 and 3. As illustrated in Fig. 1, the clamping plates 32 and 34 are provided with arcuate upper edges generally concentric with the outer peripheral edge of the panel 18 and as illustrated in FIG. 2, the clamping plates 32 and 34 have a shallow convex configuration to facilitate their engagement with the pleats 20 in the panel 18. This structure provides for adjustment of the pleats 20 and the panel 18 which allows the panel to be permanently adjusted while in place in order to accommodate a slightly irregular window casing structure. Also, the compression of the pleats enables the fan-like panel 18 to stand on its own without top brackets in a manner which will not permit collapse of the panel which does not fold between an opened and closed position.

A pleated valance 42 having a plurality of horizontal pleats 44 is secured to the outer face of the mounting rail 22 and includes a backing member 46 extending between the upper and lower pleats and secured to the mounting rail by fasteners 48 such as staples, rivets, bolts or adhesive bonding material with the pleated valance complementing the pleats 20 forming the panel 18.

A semicircular fan-type medallion generally designated by numeral 50 overlies the central lower portion of the fan-like panel 18 and includes an outer peripheral edge generally concentric with the outer peripheral edge of the fan member 18. The medallion also includes a plurality of radially extending pleats 52 radiating from a central bottom edge with a smaller panel 54 overlying the juncture between the inner ends of the pleats 52. The lowermost pleat is downturned as at 56 and extends downwardly between the upper pleat on the valance and the mounting rail 22. As illustrated FIG. 2, the medallion 50 has some degree of convexity to it by it being engaged with the outer surface of the clamping plate 34 as illustrated in FIG. 2. Thus, the medallion is fixed in relation to the remainder of the blind with the crests of the pleats forming the medallion being staggered in relation to the crests in the panel 18 to provide enhanced appearance characteristics to the blind.

With this construction of a fan-type blind, a semicircular arched window can be provided with a blind which is stationary since it does not move between open and closed positions with the bottom edge of the blind being supported by a rigid mounting rail and the arcuate portion of the blind being retained in desired relationship by clamping plates 32 and 34 and a clamping bolt 38 which by tightening the nut 40 will compress the opposite crests of the fan-like panel to enable the panel to be adjusted to accommodate irregular window casings and securely retain the pleats in their final adjusted position with attachment to the mounting rail stiffening and rigidifying the lower edge of the panel and the clamp plates and clamp bolt arrangement serving to rigidify and stabilize the fan member.

The foregoing is considered as illustrative only of the principles of the invention. Further, since numerous modifications and changes will readily occur to those skilled in the art, it is not desired to limit the invention to the exact construction and operation shown and described, and, accordingly, all suitable modifications and equivalents may be resorted to, falling within the scope of the invention.

What is claimed is as follows:

1. In combination with a substantially semicircular window having a straight bottom edge, a blind comprising a fan-shaped radially pleated member of semi-rigid, shape-sustaining material and having opposing end pleats which are aligned to form an elongated, substantially straight bottom edge, a horizontally disposed one-piece, substantially straight, stationary mounting rail along the bottom edge of said member, the bottom edge of said member being secured to said mounting rail for rigidifying said member and maintaining said member in a fan-shaped configuration and in stationary aligned registry with said window, bracket means for supporting said mounting rail at the bottom edge of the window, said mounting rail including means along an upper edge thereof supportingly connected to horizontally aligned end pleats on said pleated member, and means on said rail exerting inward pressure on opposed surfaces of a central bottom portion of said pleated member to rigidify the member and to enable radial adjustment of the pleats to accommodate variations in the configuration of the window.

2. The combination as defined in claim 1 together with a horizontal fascia overlying and concealing the surface of the mounting rail expose horizontally below said pleated member.

3. The combination as defined in claim 1 wherein said means exerting pressure on the opposed surfaces of the pleated member includes a pair of compression plates on the mounting rail and means to move the compression plates towards and away from each other.

4. A blind for a window having a straight peripheral portion and a curved peripheral portion, said blind comprising a rigid one-piece mounting member, means adapted to support said mounting member from the straight peripheral portion of the window, a pleated panel having a straight peripheral portion and a curved peripheral portion, means securing the straight peripheral portion of said panel to said mounting member, said panel being generally the same shape and size as the window and adapted to be positioned in aligned registry with the window, said panel including a plurality of pleats radiating from a central portion of the straight portion of the panel and extending to the curved edge portion thereof, said means securing the panel to the mounting member including means connecting remote radial pleats to the mounting member, said panel being constructed of semi-rigid material to sustain the configuration of the radial pleats, said pleats having inner ends free of said mounting member to enable the pleats to be radially adjusted to an extend sufficient to conform the curved peripheral portion of the panel to the curved peripheral portion of the window and means interconnecting the inner ends of intermediate pleats and said mounting member to retain the radial pleats in adjusted position.

5. The blind as defined in claim 4 wherein said mounting member is an elongated rigid one-piece mounting rail having a longitudinally continuous upwardly facing opening therein, said opening receiving the remote radial pleats therein, said means connecting the remote pleats to the mounting member including means enabling radial movement of the remote pleats in relation to said mounting rail.

6. The blind as defined in claim 5 wherein the inner ends of the pleats are spaced from each other and define an opening through the panel at a central portion of the straight peripheral portion, said means interconnecting the inner ends of the intermediate pleats and the mounting member including a pair of opposed clamp plates extending from the mounting rail toward the curved peripheral portion of the panel a distance sufficient to engage opposed crests of the inner ends of the intermediate radial pleats, and means extending through the opening in the panel and engaged with the clamp plates to move the clamp plates to selectively exert clamping force on the crests of the pleats to enable radial adjustment of the pleats in the absence of opposed clamping force being exerted on the inner ends of the pleats and securing the pleats in adjusted position and rigidifying the inner ends of the pleats when clamping force is exerted on the inner ends of the pleat by said clamp plates.

7. The blind as defined in claim 6 wherein said clamp plates are connected to said mounting rail and a pleated medallion member covering the outer clamp plate with the pleated medallion and the pleated panel forming continuous pleats from the central portion of the straight peripheral portion of the panel to the curved peripheral portion thereof.

* * * * *